US005712621A

United States Patent [19]

Andersen

[11] Patent Number: 5,712,621

[45] Date of Patent: Jan. 27, 1998

[54] SECURITY SYSTEM WITH VARIABLE INDUCTANCE SENSOR

[76] Inventor: James D. Andersen, 123 I Ave., Coronado, Calif. 92118

[21] Appl. No.: 659,663

[22] Filed: Jun. 6, 1996

[51] Int. Cl.[6] ..... G08B 13/08

[52] U.S. Cl. ..... 340/547; 340/551; 340/941; 324/207.16; 324/207.24

[58] Field of Search ..... 340/545, 547, 340/550, 551, 941, 561; 324/207.16, 207.22, 207.24, 207.26, 236

[56] References Cited

U.S. PATENT DOCUMENTS

| | | | |
|---|---|---|---|
| 3,087,145 | 4/1963 | Fruh | 340/545 |
| 3,233,054 | 2/1966 | Shoffstall | 340/545 |
| 3,967,262 | 6/1976 | Reich et al. | 348/551 |
| 4,030,089 | 6/1977 | Wurfel | 340/550 |
| 4,092,636 | 5/1978 | Shepherd, Jr. | 340/545 |
| 4,209,777 | 6/1980 | Morrison | 340/547 |
| 4,438,430 | 3/1984 | Young et al. | 340/547 |
| 4,647,910 | 3/1987 | Torre | 340/551 |
| 4,658,241 | 4/1987 | Torre | 340/551 |
| 4,672,230 | 6/1987 | Spahn | 324/207.26 |
| 4,864,288 | 9/1989 | Cross | 340/669 |
| 4,999,608 | 3/1991 | Galomb | 340/550 |
| 5,007,199 | 4/1991 | Dunagan et al. | 340/547 |
| 5,012,206 | 4/1991 | Tigges | 331/65 |
| 5,107,211 | 4/1992 | Rose | 324/207.16 |
| 5,111,139 | 5/1992 | Rose | 324/207.22 |
| 5,164,705 | 11/1992 | Dunagan et al. | 340/547 |
| 5,331,277 | 7/1994 | Burreson | 324/207.16 |
| 5,376,921 | 12/1994 | Trikilis | 340/551 |
| 5,469,054 | 11/1995 | Bicking | 324/207.22 |
| 5,489,888 | 2/1996 | Jagiella et al. | 340/572 |
| 5,504,425 | 4/1996 | Fericean et al. | 324/207.16 |
| 5,534,849 | 7/1996 | McDonald et al. | 340/547 |

FOREIGN PATENT DOCUMENTS

| | | | |
|---|---|---|---|
| 2082828 | 3/1982 | United Kingdom | 340/545 |

*Primary Examiner*—Brent A. Swarthout
*Assistant Examiner*—Van T. Trieu
*Attorney, Agent, or Firm*—Brown, Martin, Haller & McClain

[57] ABSTRACT

A security system that includes an inductive sensor commonly known as a "proximity sensor" or "variable reluctance sensor", an alarm unit, and a controller that allows a user to position the movable structure on which the sensor is mounted, e.g., a door or window, at a selected position and then arm the security system with the structure in that position to detect movement of the structure away from the selected position. For example, the user may open a window on which the sensor is mounted and then arm the alarm to trigger upon detection of movement of the window from that position or, alternatively, only upon detection of further opening of the window or, alternatively, only upon detection of closing of the window. A user could thus open a window a small, selected amount to admit fresh air without triggering the security system or open a door a small, selected amount to receive a caller or allow pets to enter or leave the premises without triggering the security system.

35 Claims, 7 Drawing Sheets

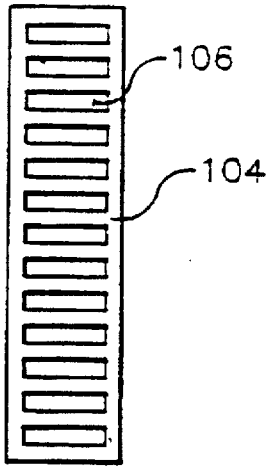
Fig. 5
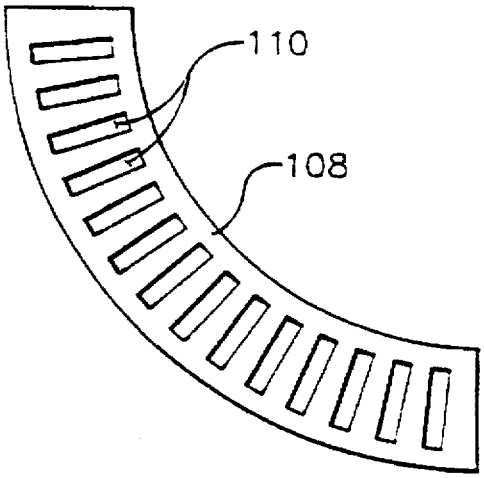
Fig. 6
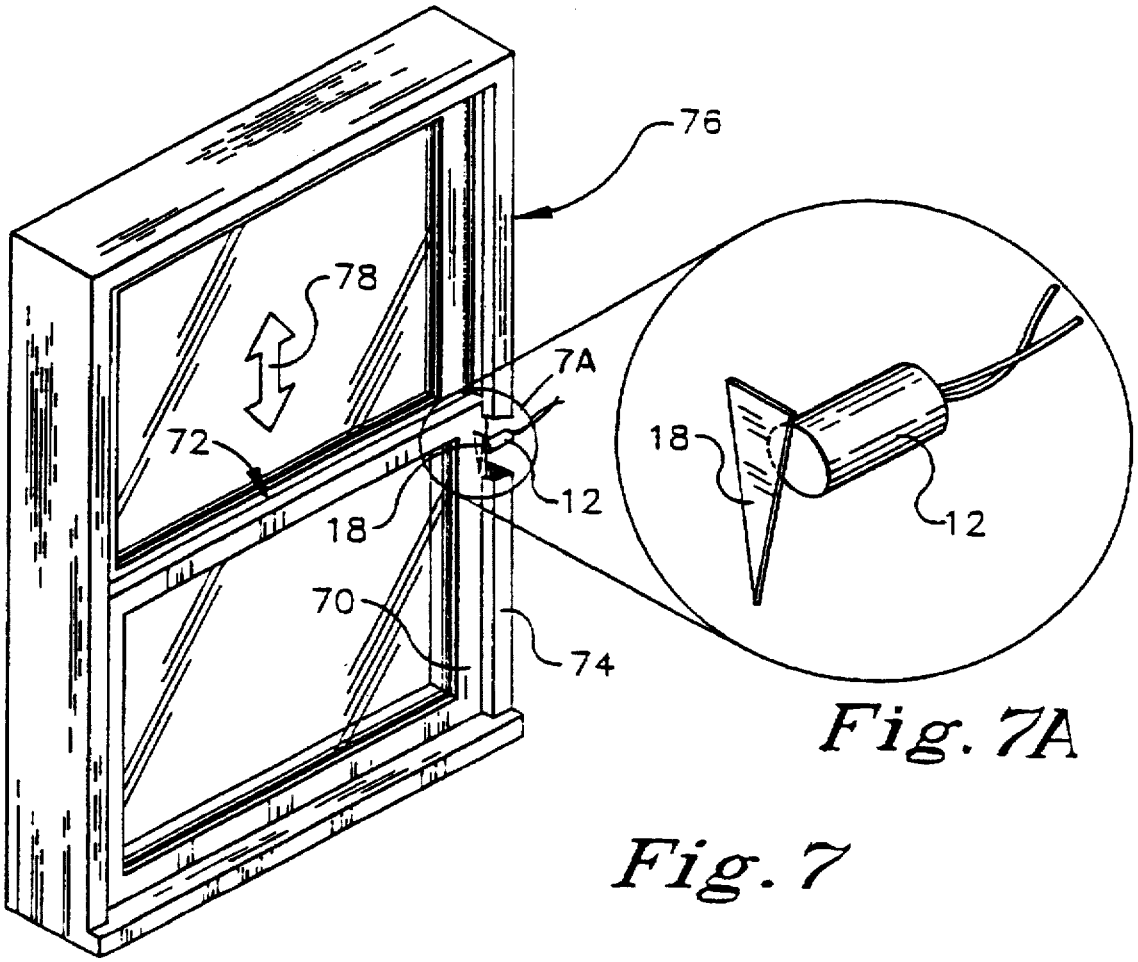
Fig. 7A
Fig. 7

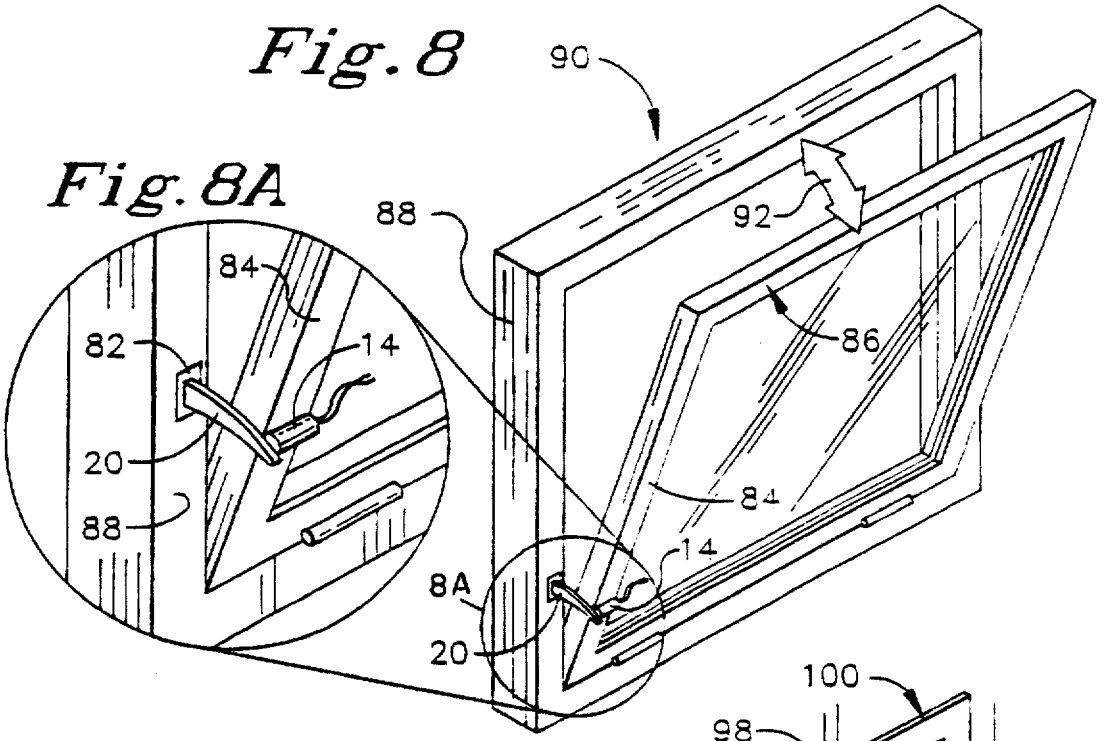
Fig. 8
90
88
92
86
84
14
8A
20
Fig. 8A
84
82
14
20
88
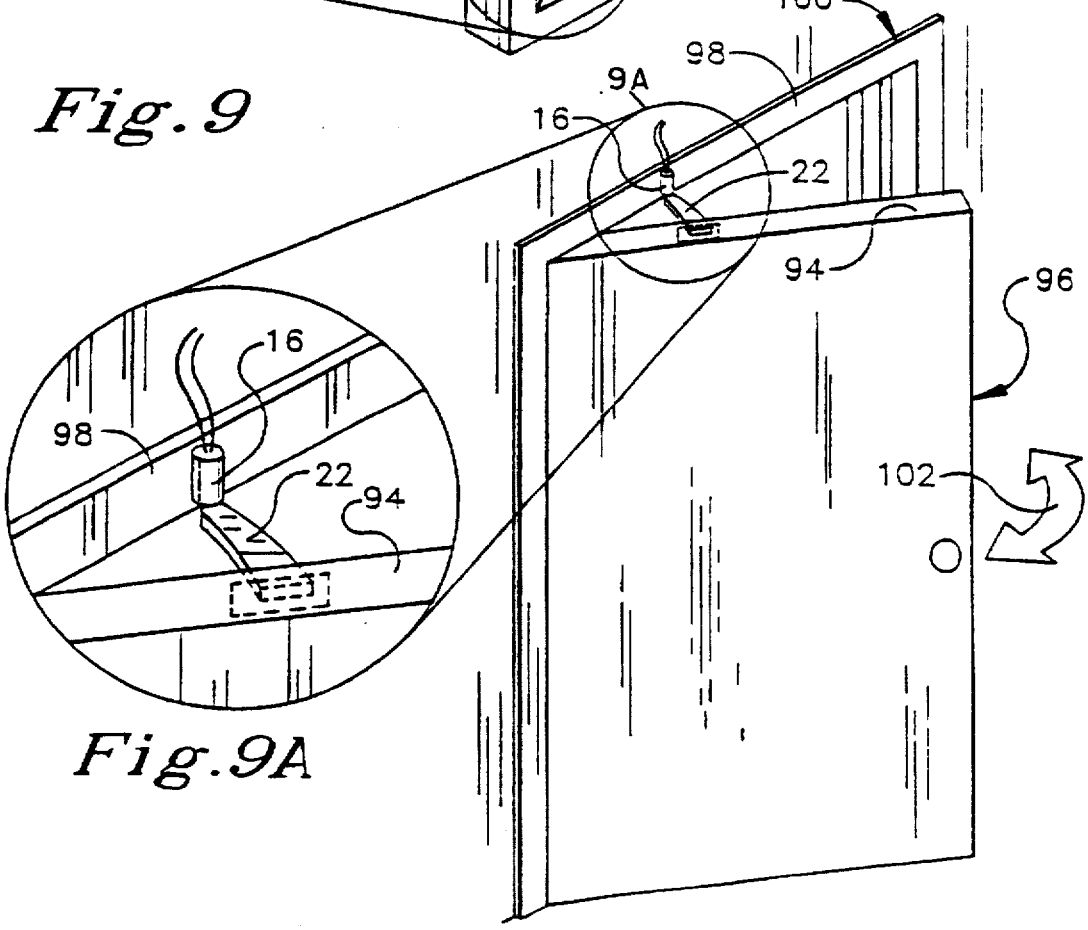
Fig. 9
100
98
9A
16
22
94
96
102
Fig. 9A
16
98
22
94

SECURITY SYSTEM WITH VARIABLE INDUCTANCE SENSOR

BACKGROUND OF THE INVENTION

Security or alarm systems are used to detect intruders in dwellings or other buildings. A security system typically includes one or more sensors for detecting the intruder or breach of the perimeter of the building, an alarm, and a control unit. The alarm is typically either a siren that generates an audible signal or an automatic transmitter, such as a telephone dialer, that sends a signal to a remote monitoring station to notify monitoring personnel of the intrusion. In response to the activation of a sensor, the control unit activates the alarm.

The sensors are typically either of the contact type, such as magnetic reed switches, or the non-contact type, such as infrared or ultrasonic. Non-contact sensors detect movement of the intruder within the premises by radiating a signal and detecting reflections of the signal. Contact sensors make or break an electrical circuit. So-called normally-closed contact sensors break an electrical circuit in response to an intrusion event. For example, a reed switch mounted on a window frame or door jamb may break an electrical circuit if an adjacent magnet mounted on a window or door moves away when the window or door is opened. Similarly, a strip of metallic film adhered to a window pane may break an electrical circuit when the glass shatters. Although less common in security systems, so-called normally-open contact sensors make an electrical circuit in response to an intrusion event.

An intruder may defeat or bypass a normally-closed contact sensor either by connecting jumper wires across the sensor or by otherwise forcing it to remain in a closed position. An intruder may then open the door or window without triggering the alarm because the jumper wires maintain the current in the electrical circuit. An intruder may similarly defeat a reed switch by slipping a thin magnetic strip between the switch mounted on the window frame or door jamb and the magnet mounted on the window or door. An intruder may then open the door or window without triggering the alarm because the magnetic strip maintains the reed switch in a closed position.

Contact sensors are actuated when the structures, such as windows and doors, to which they are attached move beyond a pre-set threshold. (The threshold is typically the fully closed position of the window or door.) The user of the security system, who is typically the owner or custodian of the premises, cannot adjust the alarm or select this threshold to prevent certain movements of the structure from triggering the security system while allowing other movements to trigger the system. In other words, a user must fully close each door and window on which a contact sensor is mounted before arming the security system. Any amount of opening of a door or window will trigger the security system.

It would be desirable to provide a security system having sensors that are resistant to tampering. It would further be desirable to increase the flexibility of a security system by allowing a user to adjust its triggering parameters.

These problems and deficiencies are clearly felt in the art and are solved by the present invention in the manner described below.

SUMMARY OF THE INVENTION

The present invention is a security system that includes an inductive sensor commonly known as a "proximity sensor," an alarm unit, and a controller that allows a user to position the movable structure on which the sensor is mounted, e.g., a door or window, at a selected position and then arm the security system with the structure in that position to detect movement of the structure away from the selected position. For example, the user may open a window on which the sensor is mounted and then arm the alarm to trigger upon detection of movement of the window from that position or, alternatively, only upon detection of further opening of the window or, alternatively, only upon detection of closing of the window. A user could thus open a window a small, selected amount to admit fresh air without triggering the security system or open a door a small, selected amount to receive a caller or allow pets to enter or leave the premises without triggering the security system.

Proximity sensors, also known as variable reluctance sensors, are used extensively in aircraft to sense the position of various access doors and actuators. The sensor is stimulated with an AC signal, and the frequency or the phase shift is monitored by a sensing circuit. The inductance or, equivalently, a property that varies with inductance, such as frequency or phase, varies with the gap between the sensor and a metal target. Unless specifically stated otherwise, for purposes of convenience the term "inductance" is used herein to refer not only to inductance but also to any such property that varies with the gap between an inductive proximity sensor and its target.

In the present invention, the proximity sensor is mounted on a first portion of a portal through which unauthorized entry into the premises is possible, such as inside a window frame, and an elongated metal target is mounted on a second portion of the portal to be monitored, such as the side or sash of the window. The shape or other inductively detectable feature of the target varies along its length and may in certain embodiments change in a monotonic manner in a direction from one end of the target toward the other. For example, the feature may be a tapering width. The controller produces a signal, either continuously or intermittently at any suitable times, that stimulates the proximity sensor. Moving the first portion of the portal relative to the second portion changes the inductance. In response to the change in inductance, the controller activates the alarm unit, which may be of any suitable type known in the art, such as a siren or a transmitter such as a telephone dialer.

For a window that slides vertically in its frame, the target may, for example, be a relatively tall, narrow triangle with its vertex near the top of the window and its base near the bottom (or vice versa). Because the taper is monotonic, the proximity sensor defines a unique inductance for every possible relative position between it and the target. Moving the window in one direction increases the inductance, and moving the window in the other direction decreases the inductance. The controller can thus detect not only the occurrence of movement of the sensor with respect to the target, but also the direction in which such movement occurs. Therefore, the controller may be programmed to trigger the alarm only if the inductance decreases or, alternatively, only if it increases from the inductance at the time the alarm was armed. The shape of the target preferably conforms to the shape or path of travel of the portal. For example, an arcuate target may be mounted on a portion of a swinging window, door or gate, while a straight target may be mounted on a portion of a sliding window or door.

Not only will the security system be triggered if the window, door or other portal is moved, but the system will also be triggered if a person: disconnects the sensor, e.g., by cutting the wires; attempts to bypass the sensor by attaching a jumper wire across it; places a metal object, such as a screwdriver, crowbar or other tool, in close proximity to the sensor; or connects a multimeter or other electronic diagnostic equipment to the sensor leads in an attempt to discover how to defeat the system. Merely connecting the test probes of common electronic test equipment may vary the inductance in the alarm circuit by an amount sufficient to trigger the security system.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein:

FIG. 5 is a front elevation view of another alternative target for a proximity sensor;

FIG. 6 is a front elevation view of still another alternative target for a proximity sensor;

FIG. 7 is a perspective view of a proximity sensor and target mounted on a vertically sliding window;

FIG. 8 is a perspective view of a proximity sensor and target mounted on a casement window;

FIG. 9 is a perspective view of a proximity sensor and target mounted on a door.

DESCRIPTION OF A PREFERRED EMBODIMENT

Figure 1:
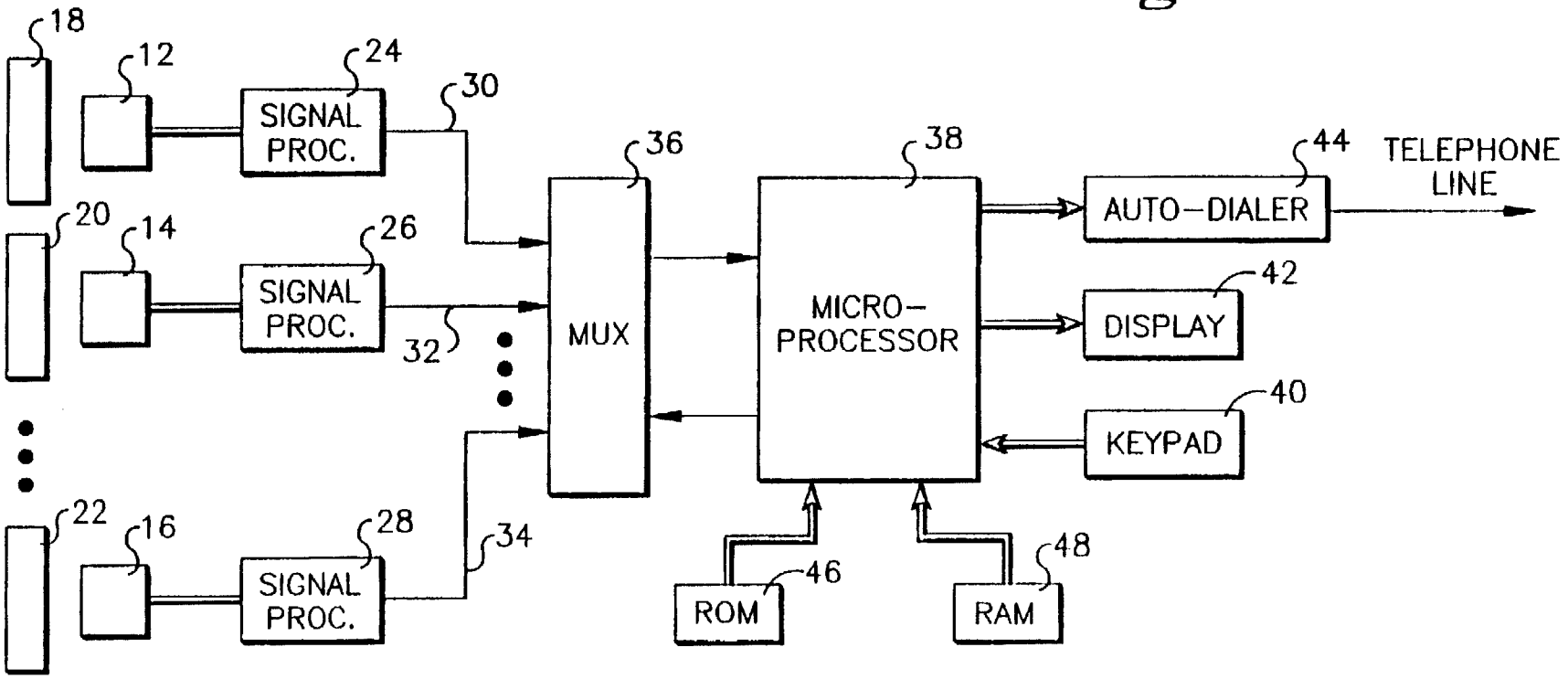
FIG. 1 is a block diagram of the security system having inductive proximity sensors.

As illustrated in FIG. 1, a security system includes one or more inductive proximity sensors 12, 14 and 16, and corresponding targets 18, 20 and 22, respectively. Proximity sensors 12, 14 and 16 are inductive sensors of the well-known type commonly used, for example, in aircraft for sensing the positions of access doors and actuators. A suitable type of proximity sensor is manufactured by ELDEC Corp. of Lynnwood, Wash., part number 8-716-01. As described in further detail below, proximity sensors 12, 14 and 16, and targets 18, 20 and 22 are mounted on doors or windows of a premises, such as a dwelling or other building, to be monitored against unauthorized intrusion. Signal processing circuits 24, 26 and 28 are connected to proximity sensors 12, 14 and 16, respectively. As described in further detail below, signal processing circuits 24, 26 and 28 stimulate proximity sensors 12, 14 and 16 with an alternating current (AC) signal and produce corresponding output signals 30, 32 and 34 that change in frequency in response to changes in inductance of proximity sensors 12, 14 and 16. A multiplexer (MUX) 36 routes signals 30, 32 and 34 to a microprocessor 38. Microprocessor 38 receives input from a keypad 40 and provides output to a display 42 and an alarm device, such as an auto-dialer 44. Microprocessor 38 operates in accordance with software stored in a read-only memory 46. A random-access memory 48 provides temporary data storage.

Figure 2:
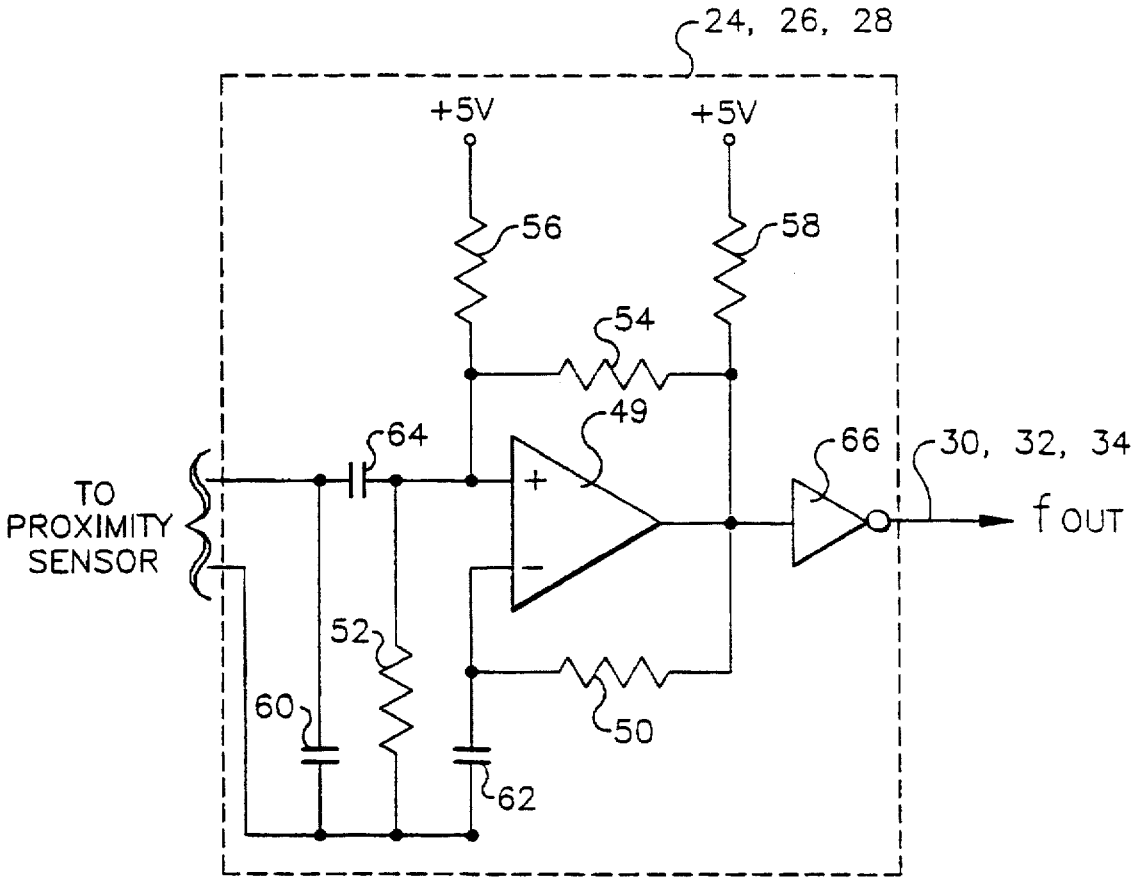
FIG. 2 is a schematic diagram of the signal processing block of the security system illustrated in FIG. 1.

As illustrated in FIG. 2, signal processing circuits 24, 26 and 28 each include a comparator 49, five resistors 50, 52, 54, 56 and 58, three capacitors 60, 62 and 64, and an inverter 66. These components together form an inductor-capacitor (L-C) oscillator circuit, which produces a frequency proportional to the inductance of the one of proximity sensors 12, 14 and 16 to which the circuit is connected. Capacitor 60 is connected in parallel with one of proximity sensors 12, 14 and 16. A first terminal of capacitor 64 is connected to a first terminal of capacitor 60. A second terminal of capacitor 64 is connected to the non-inverting input of comparator 49, to a first terminal of resistor 52, to a first terminal of resistor 56 and to a first terminal of resistor 54. The second terminals of resistors 56 and 58 are connected to the positive side of a five volt power supply (not shown). The second terminals of resistors 54 and 58 are connected together and to the output of comparator 49. A first terminal of resistor 50 is also connected to the output of comparator 49. A second terminal of resistor 50 is connected to the inverting input of comparator 49 and to a first terminal of capacitor 62. The second terminal of capacitor 62, the second terminal of resistor 52 and the second terminal of capacitor 60 are each connected to ground, i.e., zero volts with respect to the five volt power supply. The input of inverter 66 is connected to the output of comparator 49. The output of inverter 66 provides one of signals 30, 32 and 34. Persons of skill in the art will understand that the above-described circuit is merely exemplary; such persons will readily be capable of designing other suitable circuits for interfacing with proximity sensors 12, 14 and 16 in view of the teachings herein.

Targets 18, 20 and 22 each comprise a structure having at least one inductively detectable feature that varies along its length. The feature may vary in any suitable manner that produces inductive variations as a proximity sensor is moved along its length. For example, the varying feature may be apertures or protuberances on the target. Alternatively, for example, the feature may be the width of the target. Although any type of variation may be suitable in certain embodiments, the variation is preferably either periodic or monotonic. For example, a variation in apertures could be the aperture size or spacing or both. A periodic variation could be, for example, two apertures per centimeter of target length. A monotonic variation could have a steadily increasing (or decreasing) aperture size or spacing or both. Similarly, a periodic variation in target width could be, for example, two changes in target width per centimeter of target length. A monotonic variation could be a steadily increasing (or decreasing) target width. The rate of increase or decrease may be constant, such as an increase in width of one millimeter per centimeter, or may itself vary.

Figure 3:
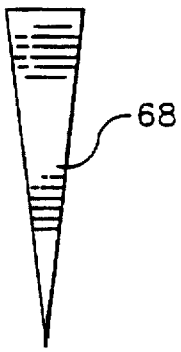
FIG. 3 is a front elevation view of a target for a proximity sensor.

As illustrated in FIG. 3, a suitable target 68 is made of sheet metal in the shape of an isosceles triangle. Thus, the width decreases or tapers monotonically, i.e., does not increase at any point, from the base to the vertex of the triangle. The width of target 68 is inductively detectable because the mutual inductance between it and one of proximity sensors 12, 14 and 16 varies in response to amount of metal immediately adjacent the sensor, and the amount of metal varies with the width.

The structure defined by target 68 is suitable for detecting linear movement. For example, as illustrated in FIG. 7, target 18 may have the structure defined by target 68. Target 18 is mounted on the sash member 70 of a window sash 72 and preferably extends along essentially the entire length of sash member 70. Target 18 is preferably adhesively mounted on sash member 70 between it and a frame member 74 of a window frame 76. Proximity sensor 12 is preferably mounted in an opening drilled in frame member 72, and may be partially embedded in an adjacent wall (not shown) of the building. The distal end of proximity sensor 12 is thus flush with the surface of frame member 74. Because proximity sensor 12 is mounted in this manner, and because target 18 is thinner than the small gap between sash member 70 and frame member 74, window sash 72 can slide in window frame 76, unimpeded, in the normal manner. Moving window sash 72 vertically upward in the direction of the arrow 78 decreases the inductance of proximity sensor 12 because the width of the portion of target 18 immediately adjacent proximity sensor 12 decreases. Conversely, moving window sash 72 vertically downward in the direction of the arrow 78, i.e., closing the window, increases the inductance of proximity sensor 12 because the width of the portion of target 18 immediately adjacent proximity sensor 12 increases.

Figure 4:
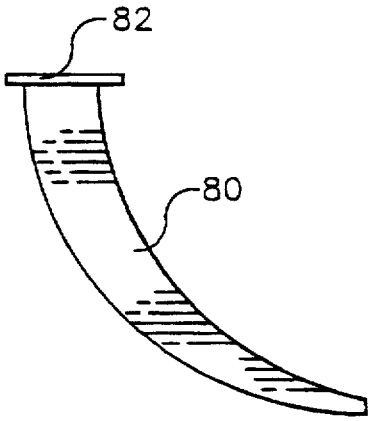
FIG. 4 is a front elevation view of an alternative target for a proximity sensor.
Figure 10A:
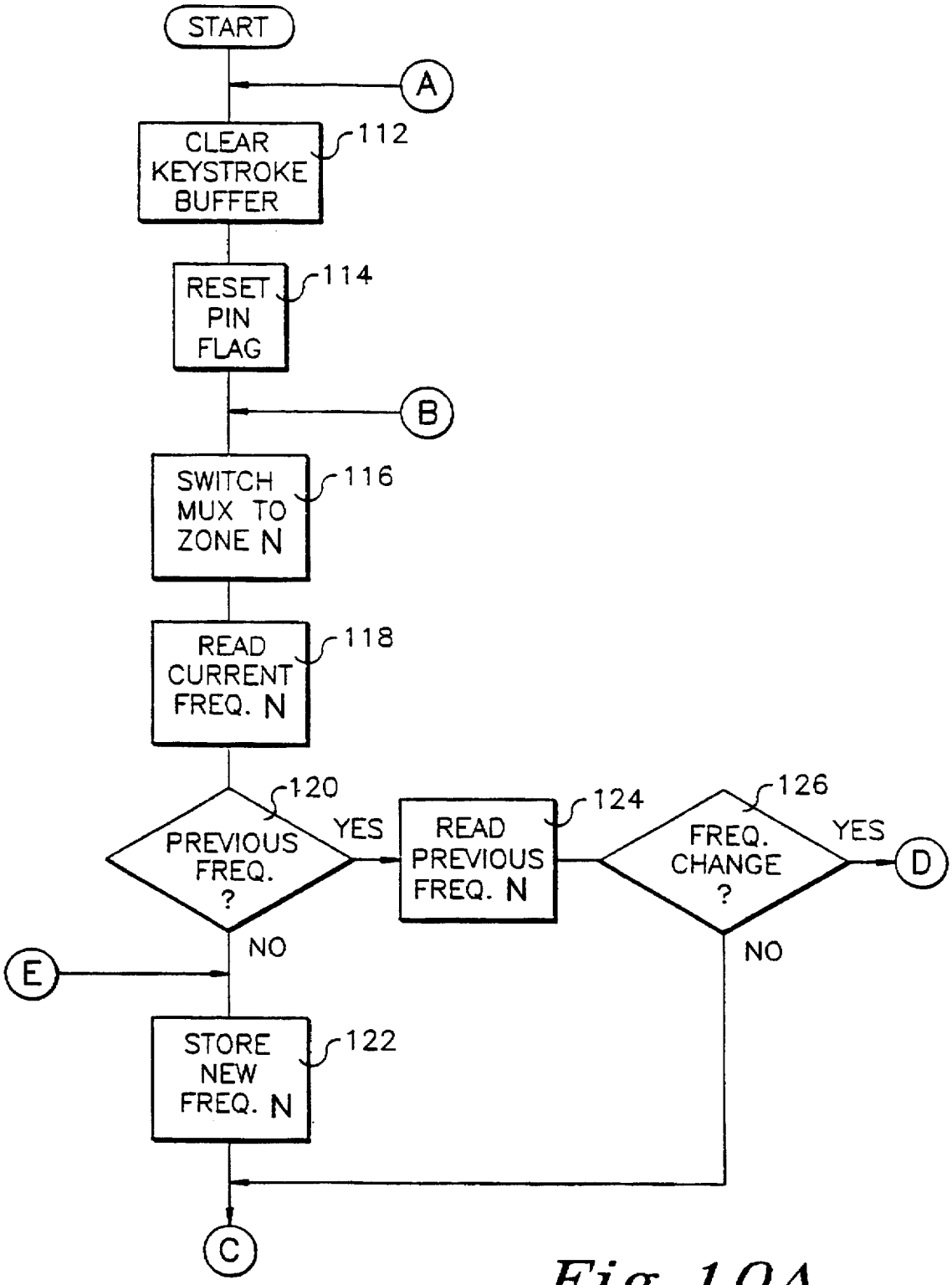
FIG. 10A–D is a flow diagram of a method for operating the security system.
Figure 10B:
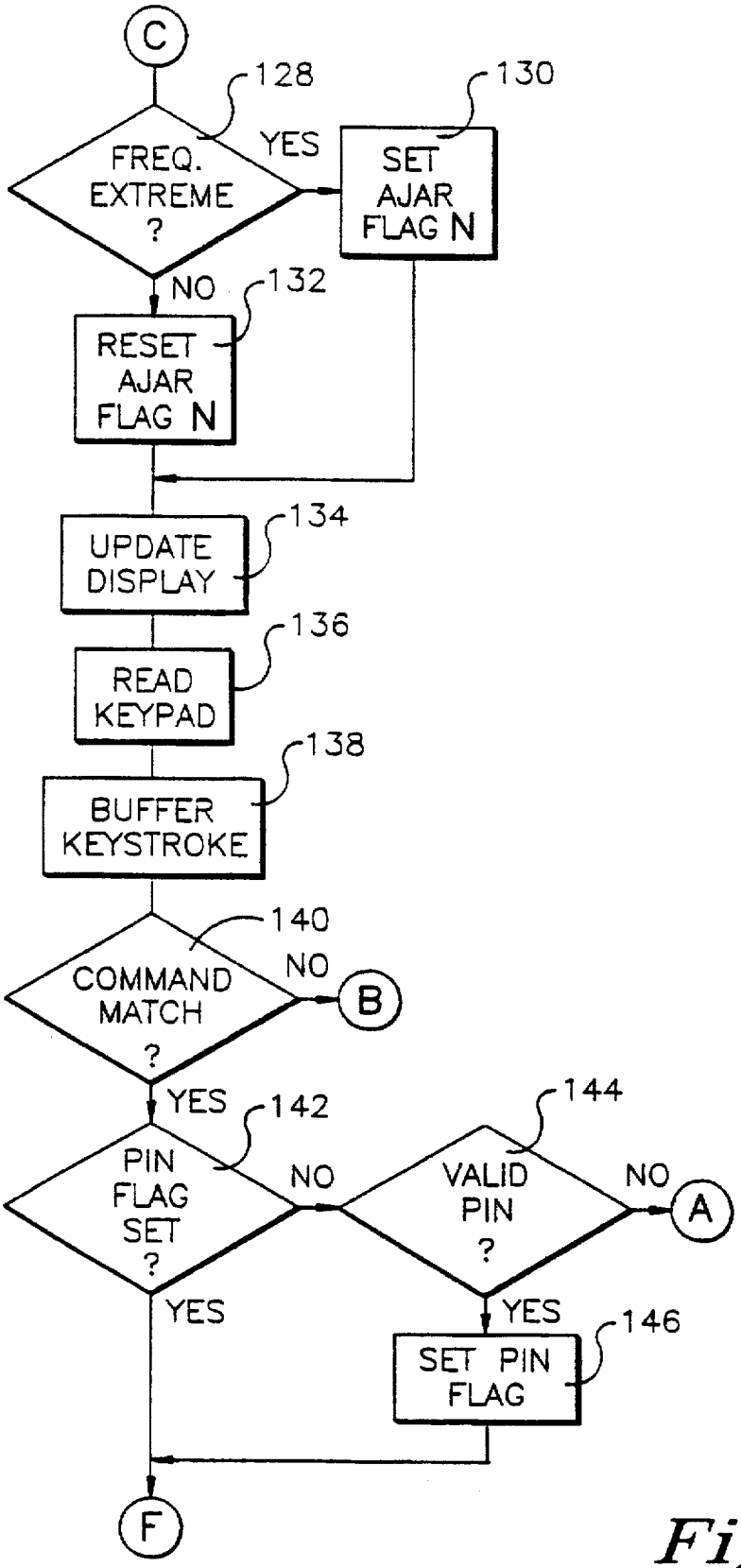
Figure 10C:
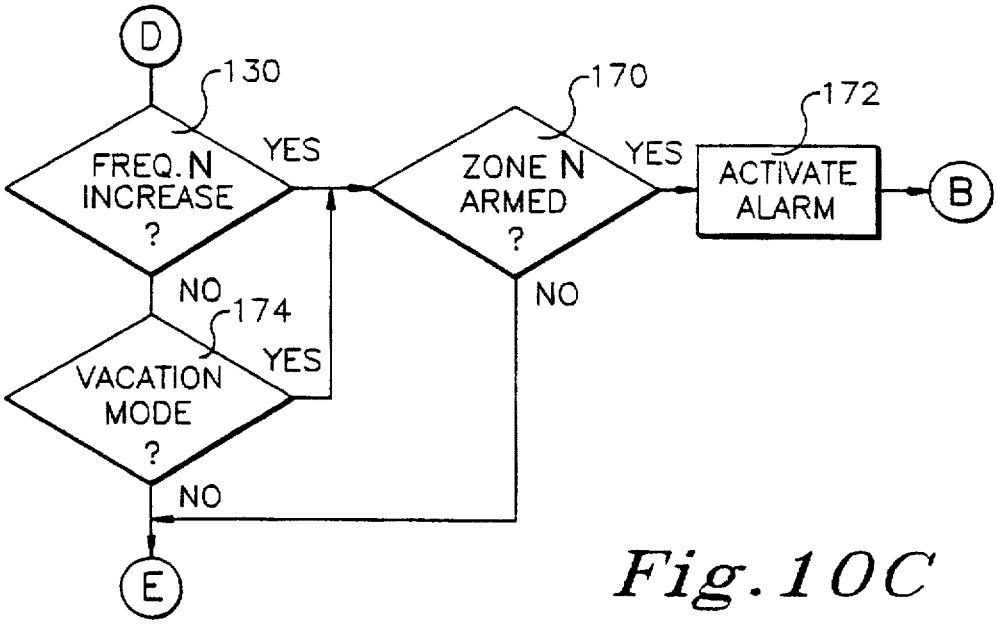
Figure 10D:
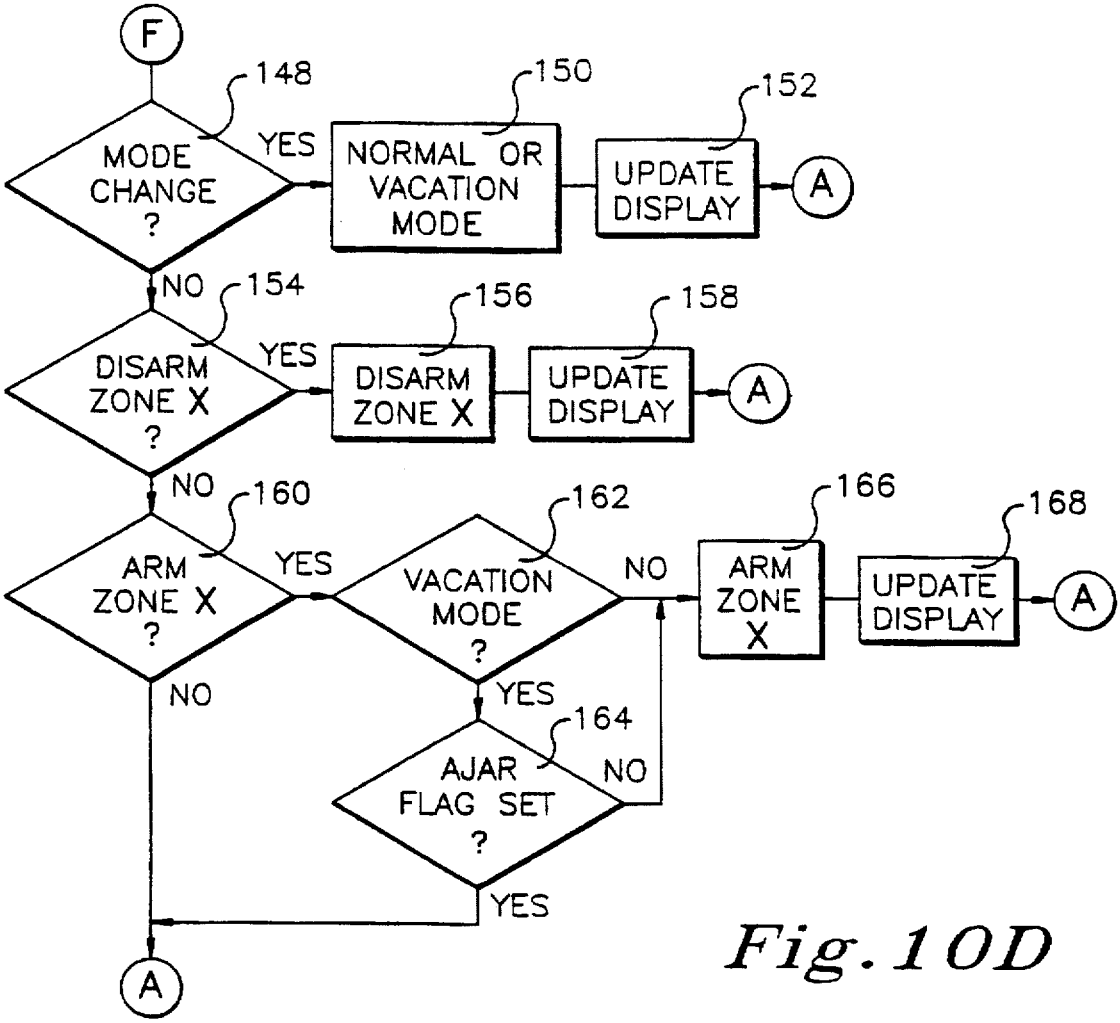

As illustrated in FIG. 4, an alternative target 80 is made of sheet metal in the shape of an arcuate or curved isosceles triangle that tapers in width. Target 80 preferably has a radius of curvature that corresponds to the structure in which it is mounted. Target 80 has a mounting bracket 82. As in target 68 in FIG. 3, the width of target 70 is an inductively detectable feature because the amount of metal is different at different points along its length.

The structure defined by target 80 is suitable for detecting curvilinear, rotary or swinging movement. For example, as illustrated in FIG. 8, target 20 may have the structure defined by target 80. Target 20 is mounted on the frame member 88 of a casement window frame 90. Mounting bracket 82 facilitates mounting target 20 on frame member 88 using screws, adhesive or similar means (not shown). Proximity sensor 14 is mounted on sash member 84 of a casement window sash 86. Casement window sash 86 can swing open with respect to casement window frame 90 in the normal manner. The curvature of target 20 corresponds to the angular movement of casement window sash 86. In other words, target 20 is mounted at a distance from the hinge of casement window sash 86 equal to the radius of curvature of target 20. Thus, the distal end of proximity sensor 14 remains immediately adjacent a portion of target 20 when casement window sash 86 is swung open. Swinging casement window sash 86 inwardly in the direction of the arrow 92, i.e., closing the window, increases the inductance of proximity sensor 14 because the width of the portion of target 20 immediately adjacent proximity sensor 14 increases. Conversely, swinging casement window sash 86 outwardly in the direction of the arrow 92, i.e., opening the window, decreases the inductance of proximity sensor 14 because the width of the portion of target 20 immediately adjacent proximity sensor 14 decreases.

The structure of target 80 may also be used, for example, to detect movement of a door. As illustrated in FIG. 9, target 22 is mounted on the top edge 94 of a door 96. Mounting bracket 82 facilitates mounting target 22 on top edge 94 using screws, adhesive or similar means (not shown). Proximity sensor 16 is mounted on frame member 98 of a door jamb 100, and may be partially embedded in a portion of the wall (not shown) above door 96. The distal end of proximity sensor 16 is thus flush with the surface of frame member 98. Because proximity sensor 16 is mounted in this manner, and because target 22 is thinner than the small gap between top edge 94 and frame member 98, door 96 can swing open in the normal manner. The curvature of target 22 corresponds to the angular movement of door 96. In other words, target 22 is mounted at a distance from the hinge of door 96 equal to the radius of curvature of target 22. Thus, the distal end of proximity sensor 16 remains immediately adjacent a portion of target 22 when door 96 is swung open or closed. Swinging door 96 in the direction of the arrow 102 changes the inductance of proximity sensor 16 because the width of the portion of target 22 immediately adjacent proximity sensor 16 changes.

As illustrated in FIG. 5, another alternative target 104 is made of sheet metal in the shape of an elongated rectangle having uniformly sized apertures 106 spaced periodically, e.g., every 0.5 centimeters, along its length. The pattern of apertures 106 is an inductively detectable feature because the inductance between target 104 and a proximity sensor when the proximity sensor is immediately adjacent an aperture 106 is different from the inductance when the proximity sensor is immediately adjacent a portion between two apertures 106. Target 104 may be mounted and used in a manner similar to target 68, described above.

As illustrated in FIG. 6, yet another alternative target 108 is made of sheet metal having a shape similar to that of target 80, described above, and having uniformly sized apertures 110 periodically spaced along its length. The pattern of apertures 110 is an inductively detectable feature. Target 108 may be mounted and used in a manner similar to target 80, described above.

Persons of skill in the art will understand that targets 68, 80, 104 and 108 are merely exemplary; such persons will readily be capable of designing other suitable targets in view of the teachings herein. Furthermore, persons of skill in the art will understand that the targets and proximity sensors may be mounted in any suitable manner in a door, window or other portal of the monitored premises. Preferably, the targets and proximity sensors are mounted in a manner that discourages tampering. The proximity sensor may be mounted on the fixed member, such as a window frame or door jamb, and the target mounted on the corresponding movable member, such as the window sash or door, as in the embodiment illustrated in FIGS. 7 and 9, respectively. Alternatively, the proximity sensor may be mounted on the movable member, such as the window sash, and the target mounted on the corresponding fixed member, such as the window frame, as in the embodiment illustrated in FIG. 8.

FIG. 10A–D illustrates the method by which microprocessor 38 operates the security system under the control of suitable software stored in ROM 46. Persons of skill in the art will readily be capable of writing such software in view of the teachings herein.

Upon powering-up the security system illustrated in FIG. 1, microprocessor 38 begins performing the method at step 112.

Microprocessor 38 begins by performing several initialization steps. At step 112 microprocessor 38 clears a keystroke buffer that it maintains in RAM 48. As described below, microprocessor 38 uses the keystroke buffer to detect commands that a user enters on keypad 40. At step 114 microprocessor 38 resets a Personal Identification Number (PIN) flag. Each user is assigned a PIN that allows the user to access the security system to arm it, disarm it, and perform other functions. Users' PINs may be stored in RAM 48. As described below, the PIN flag is set when a user has entered a valid PIN and is reset at all other times. Microprocessor 38 may maintain the PIN flag in RAM 48.

Microprocessor 38 then begins monitoring proximity sensors 12, 14 and 16. At step 116 microprocessor 38 switches MUX 36 to receive signal 30 from sensor 12 via signal processing circuit 24. Thereafter, each time microprocessor 38 performs step 116 it switches MUX 36 to receive the next ("$zone_N$") of signals 30, 32 and 34 in a circular sequence. At step 118 microprocessor 38 reads the frequency of the one of signals 30, 32 and 34 it is then receiving, i.e., the Nth signal. The output of MUX 36 is preferably connected to an I/O port of microprocessor 38 to facilitate the frequency measurement in an economical manner. Microprocessor 38 can read the frequency ("$freq_N$") by sampling the signal and timing the interval between logic level transitions. Nevertheless, other frequency measurement devices or methods known in the art would also be suitable.

At step 120 microprocessor 38 determines whether this measurement is the first that it has made of that one of signals 30, 32 and 34 following power-up. As described at step 122, microprocessor 38 maintains the measured frequency, $freq_N$, of each of signals 30, 32 and 34 in RAM 48. Thus, at step 120 microprocessor determines whether any such frequency has previously been stored in RAM 48 for the Nth signal. If no previous frequency has been stored, microprocessor 38 stores the measured frequency at step 122. If a frequency has previously been stored, microprocessor 38 reads it at step 124. At step 126 microprocessor 38 compares it to the measured frequency, $freq_N$. If the two frequencies are within a predetermined tolerance amount, such as one percent of one another, microprocessor 38 proceeds to step 128. This result indicates that the door or window corresponding to the Nth signal has not moved since the last time a new frequency was stored at step 122. If microprocessor 38 determines at step 126 that the frequency of the Nth signal has changed by more than the tolerance amount, microprocessor 38 proceeds to step 130, which is described below.

At step 128 microprocessor 38 determines whether the measured frequency is at or within a predetermined tolerance amount of one extreme of its frequency range, which indicates that the corresponding door or window is fully closed. This extreme frequency may be predetermined and stored in RAM 48. Alternatively, microprocessor 38 may measure the frequency during an initialization sequence (not shown) in which a user closes all doors and windows and enters a command to the security system to measure the frequencies and store them in RAM 48. At step 128, if microprocessor 38 determines that the frequency is not at the extreme, at step 130 microprocessor 38 sets a flag ("ajar $flag_N$") to indicate that the corresponding door or window is ajar. If microprocessor 38 determines that the frequency is at the extreme, thus indicating that the door or window is fully closed, it resets ajar $flag_N$ at step 132.

At step 134 microprocessor 38 updates display 42. Display 42 is preferably a two-line by 24 character alphanumeric display that indicates the open or closed status of each door, window or other portal having a proximity sensor or the status of each of a group of predefined "zones." As known in the security system art, security systems may monitor and indicate the status of zones covered by multiple sensors rather than the status of a single door or window. For example, each storey or floor of a multi-storey building may be defined as a zone. Display 42 also preferably indicates whether the security system is in "normal mode" or "vacation mode." These modes are described below. Thus, at step 134 microprocessor 38 updates display 42 in response to each ajar flag to indicate whether the corresponding door or window is open or closed or, in certain embodiments, whether any door or window in the corresponding zone is open or closed.

At step 136 microprocessor 38 reads keypad 40. If a key has been pressed, at step 138 microprocessor 38 stores the data thus generated in the keystroke buffer. At step 140 microprocessor 38 compares the contents of the keystroke buffer against each command in a set of predefined commands, such as "ENTER PIN XXXX" (where XXXX is a four-digit PIN), "CHANGE MODE", "ARM ZONE X", "DISARM ZONE X" (where X is a zone number or zero for all zones), and so forth. The command set may include any commands that are commonly used in security systems. A command may consist of any suitable sequence of keystrokes. For example, one key may be predefined to correspond to "ENTER PIN" and labeled with suitable indicia, and another may be predefined to correspond to "ARM ZONE" and labeled with suitable indicia. Alternatively, microprocessor 38 may display suitable prompts on display 42 to instruct the user which keys to press. Keypad 40 also preferably has ten digit keys, labeled "0"–"9". To enter a PIN, a user presses the "ENTER PIN" key followed by four digit keys. To arm zone 3, for example, a user presses the "ARM ZONE" key followed by the digit "3" key. If microprocessor 38 determines at step 140 that the keystroke buffer contains no command in the command set, microprocessor 38 returns to step 116 to sample the next one of signals 30, 32 and 34 and repeat the steps described above. Microprocessor 38 thus continues looping in this manner until either the security system is triggered or a user enters a valid command.

If microprocessor 38 determines at step 140 that a valid command has been entered, microprocessor 38 proceeds to step 142. At step 142 microprocessor 38 determines whether the PIN flag has been set. If the PIN flag has been set, microprocessor 38 proceeds to step 148. If the PIN flag has not been set, microprocessor 38 proceeds to set 144. At step 144 microprocessor 38 determines whether the command that was entered is an "ENTER PIN XXXX" command and whether the PIN matched any PIN the set of valid PINs stored in RAM 48. If the command was not "ENTER PIN XXXX" or if the PIN that was entered is not valid, microprocessor 38 returns to step 112, where it continues monitoring sensors 12, 14 and 16 and awaiting a valid PIN as described above. If a valid PIN was entered, however, microprocessor 38 sets the PIN flag at step 146 and proceeds to step 148.

When microprocessor 38 determines at step 142 that the PIN flag is already set, microprocessor 38 will respond to whichever command the user entered. At step 148 microprocessor 38 determines whether the entered command was a "CHANGE MODE" command. If the command was a "CHANGE MODE" command, at step 150 microprocessor 38 toggles a mode flag from normal mode to vacation mode or from vacation mode to normal mode. In vacation mode the security system will not arm a door or window unless it is fully closed. In normal mode, however, the security system will arm the door or window even if it is partially (or even fully) ajar. This novel feature allows a user to arm the system with a window ajar an amount sufficient to provide ventilation but insufficient to allow a person to enter. Similarly, a user could arm the system with a sliding patio or garage door ajar an amount sufficient to allow a small pet to enter and exit freely but insufficient to allow a person to enter. At step 152 microprocessor 38 updates display 42 to reflect the new mode and then proceeds to step 112 to continue monitoring and awaiting further commands.

If microprocessor 38 determines at step 148 that the entered command was not "CHANGE MODE", it proceeds to step 154. At step 154 microprocessor 38 determines whether the entered command was "DISARM ZONE X". If the command was "DISARM ZONE X", at step 156 microprocessor 38 resets one or more arm/disarm flags that correspond to the proximity sensors in that zone or in all zones if X is zero. For example, if X is one, microprocessor 38 may reset the flag corresponding to sensor 12; if X is two, microprocessor 38 may reset the flag corresponding to sensor 14; if X is three, microprocessor 38 may reset the flag corresponding to sensor 16; and if X is zero, microprocessor 38 may reset the flags corresponding to sensors 12, 14 and 16. At step 158 microprocessor 38 updates display 42 to reflect the disarmed zone or zones and then proceeds to step 112 to continue monitoring and awaiting further commands.

If microprocessor 38 determines at step 154 that the entered command was not "DISARM ZONE X", it proceeds to step 160. At step 160 microprocessor 38 determines whether the entered command was "ARM ZONE X". Immediately following power-up of the security system, a user would typically arm one or more of sensors 12, 14 and 16. If the command was "ARM ZONE X", at step 162 microprocessor 38 determines whether the mode flag indicates vacation mode. If the mode flag indicates vacation mode, at step 164 microprocessor 38 determines whether the ajar flag indicates that a door or window in that zone is ajar. As noted above, if a door or window is ajar in vacation mode, the security system will not arm that zone. Thus, if a door or window in that zone is ajar, microprocessor 38 returns to step 112 to continue monitoring and awaiting further commands. If no door or window in that zone is ajar, or if the mode flag indicates normal mode, at step 166 microprocessor 38 sets one or more arm/disarm flags that correspond to the proximity sensors in that zone. For example, if X is equal to one, microprocessor 38 may set the flag corresponding to sensor 12; if X is equal to two, microprocessor 38 may set the flag corresponsing to sensor 14; if X is equal to three, microprocessor 38 may set the flag corresponding to sensor 16; and if X is zero, microprocessor 38 may set the flags corresponding to sensors 12, 14 and 16. At step 168 microprocessor 38 updates display 42 to reflect the armed zone or zones and then proceeds to step 112 to continue monitoring and awaiting further commands.

As described above, if the measured frequency, $freq_N$, changed from the previously recorded measurement, microprocessor 38 proceeds to step 130 to determine whether the alarm should be triggered. At step 130 microprocessor 38 determines whether the frequency increased or decreased. If the frequency increased, indicating that the door or window has been opened, microprocessor 38 proceeds to step 170. At step 170 microprocessor 38 determines whether the corresponding zone is armed by testing the arm/disarm flag. If the zone is armed, at step 172 microprocessor 38 triggers the alarm. In the illustrated embodiment, triggering the alarm activates auto-dialer 44. Auto-dialer 44 is a device well-known in the art that automatically establishes a telephone connection with a remote monitoring station and transmits an alarm indication. Alternatively, triggering the alarm may activate an audible siren or any other indicator commonly used in security systems. Microprocessor 38 returns to step 116 after triggering the alarm, and a user must enter a valid PIN and disarm the security system to reset the alarm.

If microprocessor 38 determines at step 130 that the frequency decreased, microprocessor 38 proceeds to step 174. At step 174 microprocessor 38 determines whether the mode flag indicates vacation mode or normal mode. If the mode is vacation mode, microprocessor 38 proceeds to step 170 and determines whether the zone is armed, as described above. Nevertheless, if the mode is normal mode, microprocessor 38 does not trigger the alarm because, as described above, an important feature of the invention is that a window or door may be further closed without triggering the alarm. As described above with respect to the exemplary door and window installation illustrated in FIGS. 7–9, the inductance of a sensor 12, 14 or 16 decreases when the window or door on which it is mounted is closed. Thus, in normal mode microprocessor 38 does not trigger the alarm if a door or window is further closed and returns to step 122. At step 122 microprocessor 38 stores the new frequency measurement, $freq_N$, in RAM 48.

Not only will the security system be triggered if the inductance changes as a result of moving a window or door, but the system will also be triggered if a person disconnects an armed one of sensors 12, 14 and 16 by cutting or otherwise altering it, its wires, or its corresponding target 18, 20 or 22. Placing a ferrous metal object, such as a screwdriver, crowbar or other tool, in close proximity to the sensor may also increase the inductance sufficiently to trigger the alarm.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

What is claimed is:

1. A security system for monitoring a premises having at least one portal, comprising:

a proximity sensor mounted on a first portion of said portal;

an target mounted on a second portion of said portal and inductively coupled to said proximity sensor, said target elongated between first and second ends and having an inductively detectable feature varying along outer portions of said target between said first and second ends, said proximity sensor and said target movable relative to one another with said proximity sensor adjacent to and moving along said outer portions of said target between said first and second ends in response to relative motion of said first and second portions of said portal, the relative positions of said proximity sensor and each portion of said target between said first and second ends defining an inductance;

an alarm unit; and a controller connected to said proximity sensor and said alarm unit for detecting a change in said inductance and activating said alarm unit in response thereto.

2. The security system recited in claim 1, wherein said premises is a building and said portal is a window.

3. The security system recited in claim 1, wherein said premises is a building and said portal is a door.

4. The security system recited in claim 1, wherein the relative positions of said proximity sensor and each said portion of said target defines the same inductance as the relative positions of said proximity sensor and another said portion of said target.

5. The security system recited in claim 1, wherein the relative positions of said proximity sensor and each said portion of said target defines a different inductance from the relative positions of said proximity sensor and every other said portion of said target.

6. The security system recited in claim 1, wherein said target is substantially rectangular.

7. The security system recited in claim 1, wherein said target is substantially triangular.

8. The security system recited in claim 1, wherein said target is substantially arcuate.

9. The security system recited in claim 1, wherein said target is substantially planar.

10. The security system recited in claim 1, wherein said target is made of sheet metal.

11. The security system recited in claim 1, wherein said inductively detectable feature varies periodically along said portions of said target.

12. The security system recited in claim 11, wherein said inductively detectable feature comprises apertures along said portions of said target.

13. The security system recited in claim 12, wherein said target is substantially arcuate.

14. The security system recited in claim 13, wherein said target is substantially planar.

15. The security system recited in claim 14, wherein said target is made of sheet metal.

16. The security system recited in claim 12, wherein said target is substantially rectangular.

17. The security system recited in claim 16, wherein said target is substantially planar.

18. The security system recited in claim 17, wherein said target is made of sheet metal.

19. The security system recited in claim 1, wherein said inductively detectable feature varies monotonically along said portions of said target.

20. The security system recited in claim 19, wherein said inductively detectable feature is a width of said portions of said target.

21. The security system recited in claim 20, wherein said target is substantially arcuate.

22. The security system recited in claim 21, wherein said target is substantially planar.

23. The security system recited in claim 22, wherein said target made of sheet metal.

24. The security system recited in claim 20, wherein said target substantially triangular.

25. The security system recited in claim 24, wherein said target substantially planar.

26. The security system recited in claim 25, wherein said target is made of sheet metal.

27. A method for using a security system for monitoring a premises having at least one portal, comprising the steps of:

mounting a proximity sensor on a first portion of said portal;

mounting a target on a second portion of said portal in inductive communication with said proximity sensor, said target elongated between first and second ends and having an inductively detectable feature varying along outer portions of said target between said first and second ends, said proximity sensor and said target movable relative to one another with said proximity sensor adjacent to and moving along said outer portions of said target between said first and second ends in response to relative motion of said first and second portions of said portal, the relative positions of said proximity sensor and each portion of said target between said first and second ends defining an inductance;

providing an alarm unit; and providing a controller connected to said proximity sensor and said alarm unit;

arming said security system;

monitoring said inductance by said controller;

activating said alarm unit in response to a change in said inductance.

28. The method for using a security system recited in claim 27, wherein:

said step of mounting a proximity sensor on a first portion of said portal comprises mounting said proximity sensor on a window frame; and said step of mounting a target on a second portion of said portal comprises mounting said target on a window sash.

29. The method for using a security system recited in claim 28, wherein:

said target has an axis of elongation in a direction in which said target is elongated, and said window sash has an axis of travel between a fully open position and a fully closed position of said window sash; and said step of mounting said target on a window sash comprises the step of mounting said target with said axis of elongation parallel to said axis of travel.

30. The method for using a security system recited in claim 27, wherein:

said step of mounting a proximity sensor on a first portion of said portal comprises mounting said proximity sensor on a door frame; and said step of mounting a target on a second portion of said portal comprises mounting said target on a door.

31. The method for using a security system recited in claim 30, wherein:

said target has a radius of curvature, and said door has an axis of rotation about a hinge; and said step of mounting said target on a door comprises the step of mounting said target at a distance from said axis of rotation equal to said radius of curvature.

32. The method for using a security system recited in claim 27, wherein said step of activating said alarm unit in response to a change in said inductance comprises the step of activating said alarm unit in response to a change in inductance in one direction but not to a change in inductance in an opposite direction.

33. The method for using a security system recited in claim 27, wherein said step of arming said security system comprises the steps of:

adjusting the relative position of said first and second portions of said portal by a user; and providing an arming input to said controller by a user.

34. The method of using a security system recited in claim 33, wherein said step of adjusting the relative position of said first and second portions of said portal by a user comprises the step of moving one of said first and second portions of said portal having a path of travel between a fully open position and a fully closed position to a partially open position between said fully open position and fully closed position.

35. The method for using a security system recited in claim 34, wherein said step of activating said alarm unit in response to a change in said inductance comprises the step of activating said alarm unit in response to a change in inductance when said one of said first and second portions of said portal moves toward said fully open position but not to a change in inductance when said one of said first and second portions of said portal moves toward said fully closed position.

* * * * *

UNITED STATES PATENT AND TRADEMARK OFFICE

CERTIFICATE OF CORRECTION

PATENT NO. : 5,712,621
DATED : January 27, 1998
INVENTOR(S) : ANDERSEN, James D.

It is certified that error appears in the above-indentified patent and that said Letters Patent is hereby corrected as shown below:

Column 11, claim 23, line 36: after "target" insert --is--;

Column 11, claim 24, line 38: after "target" insert --is--;

Column 11, claim 25, line 40: after "target" insert --is--.

Signed and Sealed this

Fourteenth Day of July, 1998

Bruce Lehman

*Attest:*

BRUCE LEHMAN

*Attesting Officer*

*Commissioner of Patents and Trademarks*